United States Patent [19]

Shima

[11] 4,430,121

[45] Feb. 7, 1984

[54] METHOD FOR COVERING THE SURFACE OF MOLTEN METAL, AND A COVERING MATERIAL THEREFOR

[75] Inventor: Shigeru Shima, Tokyo, Japan

[73] Assignees: Nichias Corporation, Japan; Hiroyasu Iihoshi, both of Japan

[21] Appl. No.: 342,911

[22] Filed: Jan. 26, 1982

[51] Int. Cl.[3] ..... C22B 9/00

[52] U.S. Cl. ..... 75/96; 75/93 R

[58] Field of Search ..... 75/93 R, 96

[56] References Cited

U.S. PATENT DOCUMENTS

| | | | |
|---|---|---|---|
| 3,976,474 | 8/1976 | Wunder | 75/96 |
| 4,038,069 | 7/1977 | Takashima | 75/93 R |
| 4,119,468 | 10/1978 | Wiley | 75/96 |

*Primary Examiner*—P. D. Rosenberg

*Attorney, Agent, or Firm*—Wenderoth, Lind & Ponack

[57] ABSTRACT

This invention discloses a method for covering the surface of a molten metal to preserve the heat of the molten metal and to prevent oxidation of the molten metal by the surrounding atmosphere, comprising covering the surface of the molten metal with as many floating elements of a molten metal surface covering material as can be floated on the surface of the molten metal. Also disclosed is the molten metal surface covering material itself, which comprises a plurality of suitably shaped floating elements made of an inorganic refractory material, which may comprise a calcium silicate hydrate in matrix form, such as xonotlite, and may include fibrous wollastonite, or it may comprise ceramic fibers bound with an inorganic binding agent. Typically, the floating elements are substantially spherical with a diameter of 10 to 100 mm, and their density is 0.7 to 1.4 g/cm$^3$. Additionally, the floating elements may be provided with a coating layer that is insensitive to the molten metal on which the molten metal surface covering material is to be used.

14 Claims; 6 Drawing Figures

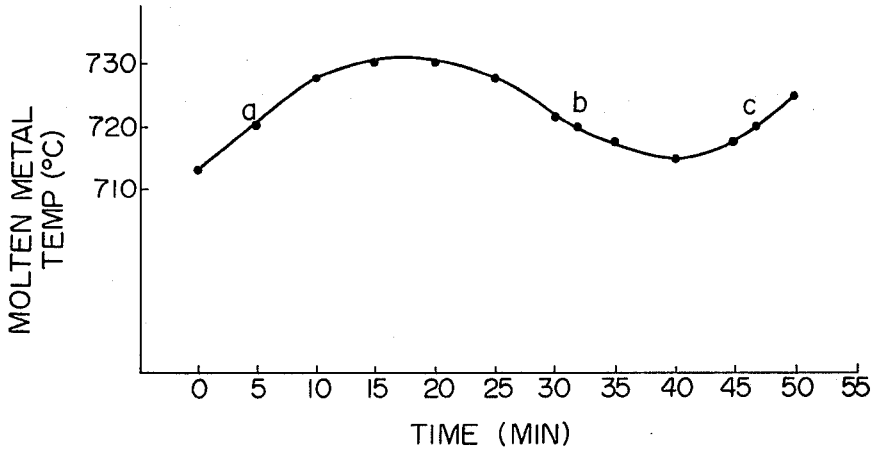
FIG. 1
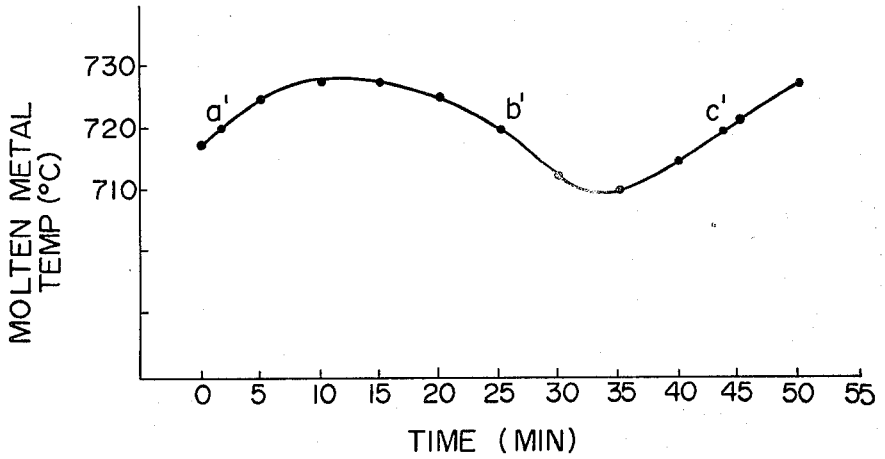
FIG. 2
FIG. 4
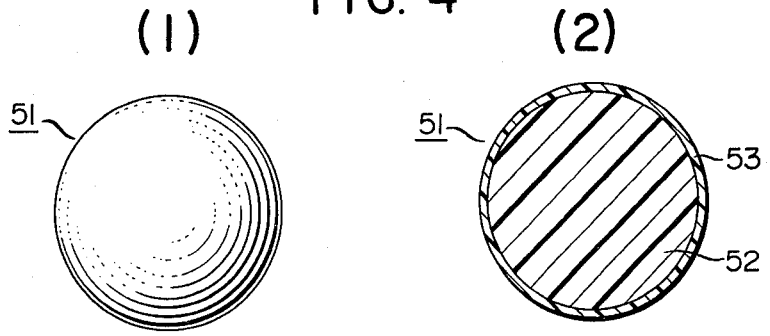

METHOD FOR COVERING THE SURFACE OF MOLTEN METAL, AND A COVERING MATERIAL THEREFOR

BACKGROUND OF THE INVENTION

1. Field of the Invention

This invention relates to a method for covering the surface of a molten metal, and in particular relates to a method for covering the surface of a molten metal in order to maintain the temperature thereof and to prevent oxidation of the surface thereof. The invention also relates to the covering material used.

2. Description of the Prior Art

In the casting of zinc, aluminum, or alloys of these metals, etc., ingots of the metal or alloy are heated in a melting furnace to obtain a molten metal which is kept in a tank, variously called a molten metal chamber, a molten metal tank, and so on. From here a desired smaller quantity of the molten metal can be obtained when required by ladling, or tapping off from the bottom of the tank. While the molten metal is stored in the tank, however, it goes without saying that it is essential to prevent heat losses from the surface of the molten metal, and thus to prevent any lowering of the temperatures thereof. Particularly in the case where the molten metal is removed by ladling, it is necessary to construct the molten metal tank with an open upper portion to allow access for the ladle, and so the potential heat losses from the surface of the molten metal are great, and so the temperature must be maintained by some means. Further, quite apart from the problem of maintaining the temperature of the molten metal, there is the problem that with certain metals, such as aluminum, the exposed upper surface of the molten metal reacts with the oxygen in air to produce an oxide of the metal, or with the water vapor in air to produce an oxide of the metal, and hydrogen. And if there is a considerable quantity of the oxide, a reduction in the quantity of the cast product is inevitable, while the hydrogen produced, if it gets absorbed into the molten metal, produces the defect known as gas porosity in the cast product.

As one method of solving these problems associated with the temporary storage of molten metal, a commonly known method has employed covering the exposed upper surface of the molten metal with a flux comprising a halide of an alkaline earth metal, or the like, while Japanese patent publication No. 54-20447 discloses a method of covering the surface of the molten metal with ceramic fibres. The former of the two methods, however, suffers the drawback that the flux is hygroscopic, and so, according to its method of storage and use, it may actually become a source of water for the molten metal, and, instead of preventing the oxidation of the molten metal, it may actually promote oxidation and the absorption of hydrogen gas. Also, in the latter method, the ceramic fibers effectively maintain the heat, but they tend to be ladled up together with the molten metal, and their subsequent removal is troublesome, on top of which, the ceramic fibers are easily mixed into the molten metal, so that, for example, after the molten metal has been used up, the ceramic fibers in the tank have to be carefully completely removed by means such as a vacuum suction pump, before a new load of molten metal can be placed in the tank. Thus the latter method suffers the drawback of requiring considerable care and attention in use.

SUMMARY OF THE INVENTION

It is an object of the present invention to do away with the aforementioned defects and drawbacks of the prior art by providing a method for covering the surface of a molten metal in a tank, particularly a tank with an open upper region to allow ladling of the contents, the covering efficiently preventing heat losses from the molten metal, and preventing the production of an oxide of the metal on the surface of the molten metal, even during the process of ladling, while giving rise to no substantial other difficulties or mishaps during such process of ladling. The present invention also intends to present a suitable material for use in the foregoing method.

These and other objects are achieves according to this invention by a method involving floating a plurality of molten metal surface covering material spheres on the surface of the molten metal so as to cover the same. The molten metal surface covering material of this invention comprises substantially ball-like or spherical agglomerations of a refractory material of a density lower than that of the molten metal, thus enabling it to float on the surface of the molten metal, with a high concentration of the material being floated on the surface to effectively seal the surface of the molten metal from the surrounding atmosphere, and thereby to suppress heat losses, and substantially preventing the cooling and oxidation of the molten metal, as well as the production of hydrogen gas, without the fear, such as is associated with ceramic fibers, of mixing with the molten metal. In other words, molten metal can be added to the tank over the floating covering material and the surface of the molten metal in the tank can be significantly disturbed, but the covering material will immediately be restored to its position floating on the surface, while the material also moves easily out of the way to allow a ladle to be dipped into the molten metal for ladling. Accordingly, this covering material enables the surface of the molten metal to be covered with a minimum of attention and labor, while the molten metal is also protected from contamination.

BRIEF DESCRIPTION OF THE DRAWINGS

Other objects and advantages of this invention will become apparent from the following description taken in conjunction with the accompanying drawings wherein are set forth by way of illustration and example certain embodiments of this invention.

FIG. 1 is a graph showing the results of measuring the heating of a molten metal covered with a molten metal covering material according to this invention, in an open top construction gas burner heat maintaining furnace;

FIG. 2 is a graph showing the results of the measurements of figure repeated with the molten metal not covered;

FIG. 4(1) shows one sphere of the molten metal surface covering material of FIG. 3;

FIG. 4(2) shows the sphere of FIG. 4(1) in cross-section;

DESCRIPTION OF THE PREFERRED EMBODIMENTS

Figure 3:
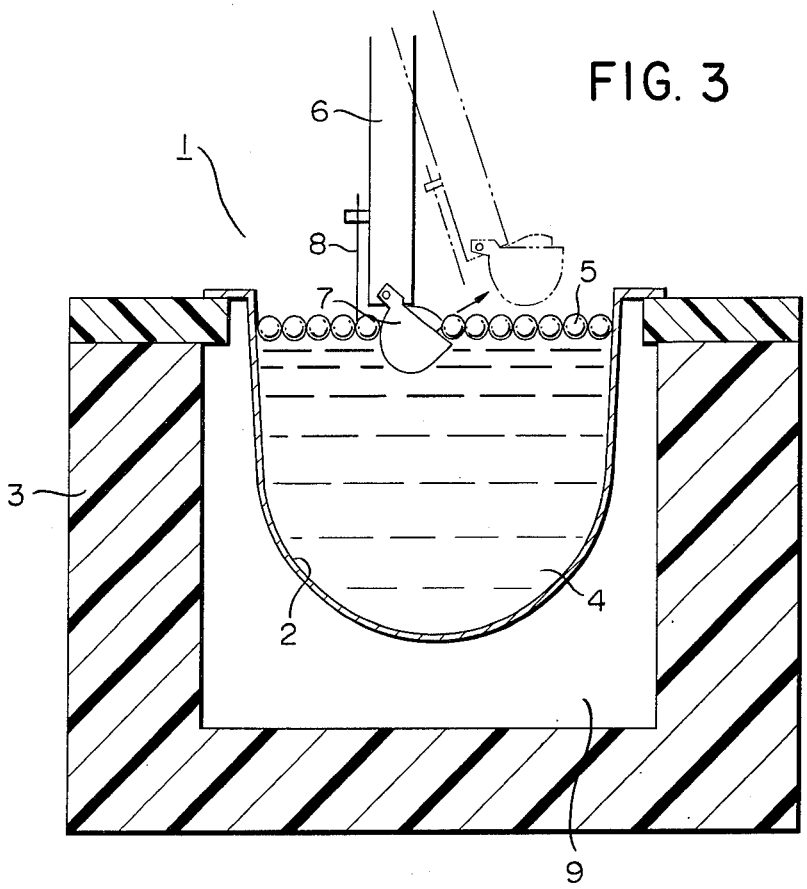
FIG. 3 is a vertical sectional view showing a molten metal surface covering material according to the present invention floating on the surface of molten metal inside a crucible.

Firstly, description in made with regard to the manufacture of the molten metal surface covering material according to the present invention.

The material of the covering material used in this invention is a heat resistant material with a melting point at least higher than the temperature at which the molten metal is maintained, of a lower density than the molten metal, and which is insensitive to the molten metal to be covered, meaning that it undergoes no substantial chemical or physical change throughout extended periods of contact with the molten metal, and which is not wetted by the molten metal. Of possible materials that satisfy these requirements, a calcium silicate hydrate in matrix is considered advantageous. This is formed in accordance with a method for manufacturing calcium silicate moldings, with a raw material and under molding conditions that produce moldings with a density of 0.7–1.4 g/cm$^3$ with an ignition loss, at 650° C., of 6 weight percent or less and preferably 5 weight percent or less. With moldings within the abovementioned range of density, the most-desirable state, or a state nearly so, in which the lower half of the individual covering material floating elements becomes submerged in the molten metal while the upper half is exposed to the air above the surface, which is necessary to obtain the optimum heat insulation effect, is achieved. Also, making the 650° C. ignition loss (i.e. the quantity of water discharged when heated to 650° C.) 6% or less, is essential to ensure a high level of heat resistance such that repeated or uneven heating by the high temperature molten metal does not cause shrinkage or cracks, and further it is necessary in order to prevent the discharging of water vapor during use which might react chemically to produce a hydrogen gas which would form bubbles in the molten metal. Conditions that are essential to achieve this are for xonotlite to make up as much of the calcium silicate as possible, and not to use asbestos which dehydrates at 400° C. and above as a reinforcing material.

Molding may be carried out by any suitable desired method, such as casting or press molding, etc., or the material may be formed into agglomerations from the outset, or after forming the desired material in a sheet form the individual spheres may be formed by cutting. As to the shape and size of the floating elements, these may be any suitable shape, but it is considered most desirable that they be ball-like spherical or polyhedral elements of even or ovoid cross-section, with an overall form and configuration that does not radically depart from that of a smooth sphere, and in size the ball-like should preferably have a diameter of between 10 mm and 100 mm. A diameter of less than 10 mm would make the spheres too small to keep out of the ladle when ladling the molten metal, as described below, while a diameter larger than 100 mm would reduce the effective cover provided by a plurality of balls, as sizable gaps might be permitted between a group of adjacent balls. As to the shape, any radical departure from smooth rounded spherical surfaces, such as in a cube with flat surfaces and pointed corners, would simply result in wearing away of the corners and edges, while the flat surfaces might allow splashes of the molten metal, such as might be produced during ladling, to rest on top of upturned flat surfaces, thereby being exposed to the air and oxidation. With a rounded spherical surface, any splashes would simply roll off and fall back down into the tank. Thus attention should be paid to the shape to ensure that it is substantially ball-like and spherical or nearly spherical.

Next, some representative methods of forming the abovementioned calcium silicate molten metal surface covering material are described.

Method of Manufacture A

This is a method whereby a pre-hydrothermally synthesized xonotlite slurry, fibrous wollastonite and water and added to a silicious material and lime materials, and these are uniformly mixed, after which the mixture is dehydration molded, and then it is steam cured and dried.

As the silicious material and lime materials, any one of the normally used raw materials of calcium silicate, such as diatomaceous earth, silicious sand, ferro-silicon dust, geyseite, slaked lime, quick lime, carbide residue, etc., may be used, with a molar ratio of $CaO:SiO_2$ of 0.6–1.2 and more preferably 0.7–1.0.

A xonotlite slurry manufactured by any normal method may be used, but particularly preferred is one manufactured by adding water to a mixture of silicious material and lime materials (in a molar ratio of $CaO:SiO_2$ of 0.8–1.0) in a quantity of 10 to 30 times the quantity of mixture, and reacting for 2 to 8 hours while stirring under a vapor pressure of 14–20 kg/cm$^2$. By composing a suitable quantity of such a xonotlite slurry, not only are the handlability and shape retention ability prior to hardening of the molded product made excellent, even without the use of asbestos, but it is also easy to obtain a product of low density, which is strong and has excellent heat resistance. Desirably, the xonotlite slurry should make up 20 to 170 parts by weight per 100 parts by weight of the total of the silicious material and lime.

As the fibrous wollastonite, a commercial product such as NYARD-G produced by Interspace Inc. of the United States of America, may be used as is. When 5–150 parts by weight of this wolllastonite are mixed with 100 parts by weight of the total weight of silicious material and lime, not only does the product acquire high heat resistance, making the production of cracks both during the manufacturing process and in use highly unlikely, but it also acquires good machinability for cutting, enabling it to be easily cut from a thick formed sheet, into the desired shape and size.

Apart from the foregoing, a small quantity of alkali resistant glass fibers may also be included in order to improve moldability.

After putting the above ingredients into a slurry form by adding a suitable quantity of water, the product is formed by dehydration molding, and by regulation of the degree of dehydration, the density can be controlled to fall within the range 0.7–1.4 g/cm$^3$, and more preferably within the range 0.8–1.0 g/cm$^3$. The product obtained is then transferred to an autoclave and is cured in steam at a vapor pressure of 6–20 kg/cm$^2$ and more preferably 8–14 kg/cm$^2$, after which it is dried. The drying is preferably carried out fully at a higher temperature than is normal in the production of normal (e.g. for building and construction use) calcium silicate molded bodies.

Method of Manufacture B

Method B involves mixing about 2–6 weight percent of Portland cement into a mixture of slaked lime and silicious sand in a $CaO:SiO_2$ molar ratio of approximately 1, and turning this mixture into a slurry by adding a large quantity of water. The resultant slurry is heated under pressure while being stirred in an autoclave to produce xonotlite. As a reinforcing material a suitable quantity of alkali resistant glass fibers are mixed in, and the product is then dehydrated, and completely dried in hot air.

Method of Manufacture C

Method C involves adding a large quantity of water to a mixture of quick lime (digested in hot water prior to use) and ferrosilicon dust in a $CaO:SiO_2$ molar ratio of approximately 1, to turn the mixture into a slurry, the slurry being reacted in an autoclave to obtain a xonotlite slurry. Subsequent steps are the same as in method B.

A molten metal surface covering material with a calcium silicate hydrate in a matrix, in normal conditions of use can be used over a long term without the surface thereof being wetted by the molten metal, and without rapid wear. However, used in conditions where the material is subjected repeatedly to particularly severe mechanical shock, the surface may be worn, leaving powderized calcium silicate floating on the surface of the molten metal, with the possibility that this powder might easily become mixed into the molten metal. Where it is thus necessary to avoid this, it is possible to coat the outer surface of the molten metal surface covering material of this invention, with a desired refractory material that does not seriously adversely affect the excellent characteristics of the covering material of this invention. This outer coating, or coating layer may be formed of, for example, a mixture of a refractory inorganic binding agent such as colloidal silica, and a variety of powder ceramic materials (e.g. zirconia, boron nitride, cordierite, steatite), powder xonotlite, wollastonite, etc.

Next, a detailed explanation is given with regard to a molten metal covering material that comprises ceramic fibers and a refractory inorganic binding agent.

The ceramic fibers employed may be any one of silica fibers, alumino-silicate fibers, zirconia fibers, etc. with a maximum temperature of use of at least approximately 1,000° C. There is no specific stipulation with regard to the diameter of the fibers, while length need only be such that it will not create problems or difficulties in the uniform adhesion of an inorganic binding agent to form agglomerations. A maximum length of about 25 cm is acceptable. Examples of a commercially available products that are suitable include Fineflex, (by Nichias Corp.), and Refraseal (manufactured by HITCO).

As the binding agent for the ceramic fiber, desirable is one that is inorganic, and that forms a gel when dehydrated by drying or heat treating to exhibit strong and heat resistant binding power. Desirable as such binding agent are colloidal silica, colloidal, alumina or colloidal zirconia. However, in view of the steps prior to the binding agent exhibiting its strength, a suitable organic high viscosity material, such as, for example, polyethylene oxide, hydroxyethyl cellulose, carboxy methyl cellulose, methyl cellulose, synthetic resin emulsion, synthetic rubber latex, etc., or clay, etc., may be used to obtain the plasticity necessary to mold the fibers.

In order to bind the ceramic fibers and mold them using these binding agents, approximately 3 times the quantity by weight of a fine powder filler may be mixed with the ceramic fibers. Suitable for mixing are an alumina powder or a high alumina mineral such a bauxite, mullite, or cyanite, or a titanium dioxide, etc., and with these durability is further improved for use at high temperatures in excess of 1,000° C.

The aforementioned inorganic binding agents used should form approximately 1 to 5 weight percent (as a dried solid at 110° C.) of the total of the ceramic fibers and filler. The greater the quantity of inorganic binding agent used the greater the strength of the covering material at normal temperatures, but when heated by high temperatures, the shrinkage becomes great, inducing easy cracking and reduced thermal shock resistance, and so it is considered desirable not to exceed the aforementioned suitable range of quantities of binding agent used.

Molding with the above materials is done in the same manner as with the calcium silicate type, mixing the raw material with a suitable quantity of water, etc.

In molding the covering material, the conditions of molding should be regulated such that the density of the molded product after drying is 0.7 to 1.4 g/cm$^3$. With the density in this range, the ball-like spheres of the covering material will float on the surface of the molten metal with approximately half the sphere below the surface and approximately half above the surface, which is or is close to, the ideal buoyancy to achieve the optimum desired covering effectiveness, and also gives substantially the best heat insulating effect.

Drying should be carried out fully in a flow of hot air at 110°–130° C.

After drying, it is considered desirable to coat the surface of the molded product with a refractory material that is substantially insensitive to the molten metal with which the covering material is to be used. Materials that can be used to form this coating layer may include the same materials as named with respect to a coating layer for the calcium silicate covering material. The coating layer is applied to compensate for the tendency of the surface of the ceramic fiber agglomeration alone to be wetted by the molten metal, or for the tendency of the ceramic fibers to form fluff on their surface, and so ordinarily it need be no thicker than 2 mm thick, or even less.

Next the present invention is explained with respect to some embodiments thereof. In the following description the term "parts" shall be taken to mean "parts by weight".

Embodiment 1

A silicious sand and milk of lime were mixed in a molar ratio of $CaO:SiO_2$ of 0.98, 12 times the mixture quantity of water was added to the mixture, and the mixture was reacted while stirring for 5 hours under vapor pressure of 16 kg/cm$^2$, to produce a xonotlite slurry. A mixture of 15 parts xonotlite, 20 parts silicious sand 21 parts slaked lime, 40 parts fibrous wollastonite (NYARD-G), 4 parts alkali resistant glass fibres, and 500 parts water were dehydration molded into a thick sheet which was steam treated for ten hours under a vapor pressure of 9 kg/cm$^2$, after which it was dried for 4 hours by placing it in a flow of warm air, to produce a molded sheet comprising chiefly xonotlite. Subsequently this sheet was cut up and worked to produce a plurality of spherical objects (the molten metal surface covering material of this invention) of a diameter of substantially 50 mm.

Five different types of molten metal surface covering material were made by the aforementioned method, varying the drying temperature within a range from 250° C. to 650° C. and the properties and heat insulation performance, etc., of these were investigated. The test for heat insulation performance consisted of filling a liquid metal tank of an open top construction (internal diameter 50 cm and depth 100 cm) to a depth of 60 cm, with molten aluminium at 700° C., and then covering the surface of the molten metal with the maximum possible quantity of the molten metal surface covering material that can be floated on the surface, and bearing the vat to stand for 2 hours, after which the temperature of the molten metal was measured and the surfaces of the molten metal covering material and the molten metal itself were observed.

The results of these property and heat insulation tests for the five types according to conditions of manufacture (i.e. according to the one variable, the temperature of drying) are shown in table 1. Note that the physical properties of the material were assessed with regard to the molded sheet of material prior to its being cut up into spheres.

TABLE 1

| Drying Temperature (°C.) | | 250 | 350 | 450 | 550 | 650 |
|---|---|---|---|---|---|---|
| Properties | Density (g/cm$^2$) | 0.83 | 0.82 | 0.82 | 0.79 | 0.81 |
| | Ignition Loss at 650° C. (%) | 2.8 | 1.2 | 0.7 | 0.3 | 0 |
| | Bending Strength (kg/cm$^2$) | | | | | |
| | →Normal Temperature | 127 | 120 | 115 | 110 | 102 |
| | After Heating at 850° C. for 3 hrs. | 80 | 78 | 77 | 76 | 76 |
| | Thermal Shrinkage (%)* | | | | | |
| | →Longitudinal | 0.4 | 0.4 | 0.3 | 0.3 | 0.1 |
| | →Thickness | 1.5 | 1.3 | 1.2 | 1.1 | 0.7 |
| Heat Insulation Test | Temp. of Molten Metal after 2 hrs. | 670 | 670 | 671 | 678 | 674 |
| | Wetting of Covering Material | none | none | none | none | none |
| | Contamination of Molten Metal | none | none | none | none | none |

*After heating at 850° C. for 3 hours

Embodiment 2

A putty-like mixture was obtained by kneading 23 parts of ceramic fiber, 65 parts of alumina powder, 12 parts of colloidal silica (20% liquid) and 50 parts water in a kneader at 200° C., and this was molded into spheres of substantially 50 mm diameter, and dried, giving spheres with a density of substantially 1.0 g/cm$^3$. Subsequently the surfaces of the spheres were coated with a mixture of silicon nitride and colloidal silica, which was dried at 350° C. to obtain the finished spherical molten metal surface covering material.

Then, the thermal insulation performance of this spherical molten metal surface covering material was investigated. The method of investigation was as follows: Molten aluminum was filled to a depth of 70 cm into an open top construction gas burner heat maintaining furnace (internal diameter: 55 cm, depth: 100 cm), and the operating times of the gas burner were compared for heating (A)a molten metal, the surface of which is covered with the maximum possible quantity of molten metal surface covering material spheres it is possible to float on the surface of the molten metal, and (B) a molten metal, the surface of which is left completely uncovered and open, to a specified temperature of 720° C. The results of this thermal insulation test are shown in FIG. 1 (representing (A)) and FIG. 2 (representing (B)), wherein the times for completing one cycle about 720° C., the specified temperature, are shown by the curves a–c and a′–c′. In (A), 42 minutes and 45 seconds was needed, while in (B) it was 42 minutes and 40 seconds, showing a small difference, but in (A) the gas burner's operating time (b–c) was 15 minutes 45 seconds, while in (B), it (b′–c′) was 20 minutes 20 seconds. In other words, there was a 4 minute 35 second reduction in operating time in (A), representing a potential sawing of 22.5% in the amount of gas consumed. The sections a–b and 1′–b′ of the curves represent the gas burner in the off state.

After this, the covering material was removed from the molten metal chamber and the state of its surface was observed. Further, the molten aluminum itself was also inspected.

The outcome of these observations showed that there has been no shrinkage of or damage to the surface covering material due to heat, and there was absolutely no wetting by the molten aluminum. Further, it was found that there was virtually no oxidation or contamination of the molten aluminum.

Next, detailed explanation will be given in conjunction with the drawings, with respect to ladling the molten metal, as one example of a method of removing a desired quantity of molten metal, when the above-described molten metal surface covering material is employed to cover and protect the molten metal surface.

Figure 5:
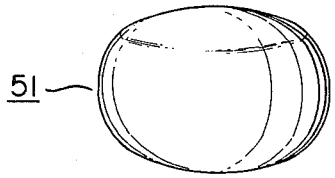
FIG. 5 is a perspective view showing an alternative configuration for the floating elements of the molten metal surface covering material of this invention.
Figure 6:
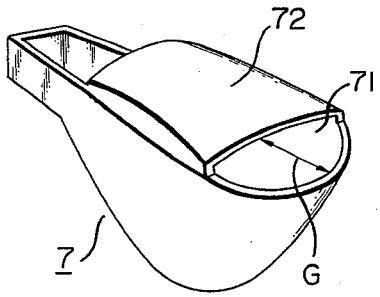
FIG. 6 is a perspective view showing a ladle suitable for use in ladling a molten metal covered by a molten metal surface covering material according to this invention.

FIG. 3 is a vertical sectional view showing a molten metal surface covering material according to the present invention floating on the surface of molten metal inside a crucible, and FIG. 4(1) shows one sphere of the molten metal surface covering material (5) in FIG. 3, while FIG. 4(2) shows a cross-sectional view of the sphere of FIG. 4(1). FIGS. 5(1) and 5(2) are perspective views showing other embodiments of a molten metal surface covering material according to this invention, and FIG. 6 is a perspective view of a ladle for ladling the molten metal covered with a molten metal surface covering material according to this invention.

Referring now to FIG. 3 wherein a crucible surface (1) comprising a crucible (2) mounted in a support frame (3), contains a molten metal (4) such as aluminum, zinc, etc., within the crucible (2), a molten metal surface covering material (5) according to the present invention comprising a plurality of spheres (51), each of which spheres (51) consists of refractory molded core (52) the surface of which is coated with a refractory coating layer (53), is caused to float on the surface of the molten metal (4) to cover and protect the same. The molten metal (4) in the crucible (2) is removed from the crucible (2) in suitable quantities by means of a ladle (7) mounted on the end of an arm (6) of a ladling mechanism, the operating mechanism of which is not shown. In the ladling process, as shown in FIG. 3, the ladle (7) enters the molten metal (4) with its top edge angled with respect to the surface of the molten metal to allow molten metal to flow in, and as the ladle (7) is lifted out of the molten metal (4), the arm (6) inclines so that the top edge of the ladle (7) becomes substantially parallel to the surface of the molten metal (4), as shown in the broken line illustration in FIG. 3, such that the molten metal (4) in the ladle (7) can be carried stably without spillage to a separate location for casting (not shown). The ladling mechanism senses the surface of the molten metal (4), i.e. its height in the crucible (2) by means of a detector (8) that extends from the arm (6), such that the ladle (7) will not be inserted deeper than necessary into the molten metal (4). The molten metal (4) in the crucible (2) is maintained in the molten state by heating by any suitable heating means (not shown) in the heating chamber (9) defined between the crucible (2) and the support frame (3).

When the molten metal (4) is ladled, the ladle (7) on the end of the arm (6) pushes aside the molten metal surface covering material (5) to pass through to and under the surface of the molten metal (4). To prevent the spheres (51) of the molten metal surface covering material (5) from flowing into the ladle (7) along with the desired molten metal (4), the ladle (7) is formed with a suitable shape such that the molten metal surface covering material (5) cannot enter. An example of such a construction is shown in FIG. 6 wherein the ladle (7) has a cover (72) which leaves an opening (71) at the forwardedge of the ladle (7) to allow molten metal (4) to enter. However the internal distance G from the front to the back of the opening (71) is so formed that it is less than the minimum diameter of the individual spheres (51) of the molten metal surface covering material (5). Other alternatives include covering the opening (71) of the ladle with a not form material through which the spheres (51) cannot pass.

To sum up, this invention comprises covering the surface of a molten metal (4) with a plurality of spheres (51) which constitute a molten metal surface covering material (5) and which float on the surface of the molten metal (4), and so the molten metal (4) is substantially prevented from coming into contact with air, suppressing the lowering of the temperature of the molten metal (4) and oxidation of the molten metal (4), as well as the production of unwanted gas porosity. Also, as the molten metal (4) is ladled out of the crucible (2) for use in casting, the level of the surface of the molten metal (4) in the crucible (2) drops, and as this level drops, the level of the molten metal surface covering material (5) also drops, and so whatever quantity of molten metal (4) remains in the crucible (2) it is effectively and fully covered and protected from the air. Further, even if ripples or waves are caused in the surface of the molten metal (4) during ladling such that a small quantity of the molten metal (4) might find its way to the upper, exposed side of the molten metal surface covering material (5), it would simply roll off the spheres (51) under the effect of gravity, the molten metal surface covering material (5) buoying itself back on top of the molten metal (4).

As explained hereinabove, the present invention has succeeded in presenting a molten metal surface covering material that is easy to use, and that is extremely effective in heat insulating the molten metal and in preventing the adverse influence of the surrounding atmosphere on the quality of the molten metal, and so enables power and energy savings in the casting process, and contributes greatly to improved quality in the cast product.

The foregoing description notwithstanding, although the description has been made with regard to a molten metal surface covering material comprising substantially ball-like spheres, the invention is not restricted thereto, and similar effects may also be obtained with individual component floating elements that are not spherical, with shapes such as shown in FIG. 5 also being suitable.

What is claimed is:

1. A molten metal surface covering material for covering the surface of a molten metal to preserve the heat of the molten metal and to prevent oxidation of the molten metal by the surrounding atmosphere, comprising a plurality of floating elements, said floating elements being made of an inorganic refractory material which is insensitive to the molten metal to be covered.

2. The molten metal surface covering material of claim 1 wherein said floating elements have a density that falls in the range from 0.7 to 1.4 g/cm$^3$.

3. The molten metal surface covering material of claim 1 wherein said floating elements are substantially spherical with a diameter that falls in the range from 10 to 100 millimeters.

4. The molten metal surface covering material of claim 2 wherein said floating elements are substantially spherical in shape with a diameter that falls in the range from 10 to 100 millimeters.

5. The molten metal surface covering material of any one of claims 1 to 4 wherein said inorganic refractory material comprises a calcium silicate hydrate in matrix form.

6. The molten metal surface covering material of claim 5 wherein said calcium silicate hydrate is xonotlite.

7. The molten metal surface covering material of claim 5 wherein said inorganic material includes fibrous wollastonite.

8. The molten metal surface covering material of any one of claims 1 to 4 wherein said inorganic material comprises ceramic fibers bound with an inorganic binding agent.

9. The molten metal surface covering material of claim 8 wherein the surface of the individual floating elements is coated with a coating layer of a material that is insensitive to the molten metal.

10. A method of covering the surface of a molten metal to preserve the heat of the molten metal and to prevent oxidation of the molten metal by the surrounding atmosphere, comprising covering the surface of the molten metal with as many floating elements of a molten metal surface covering material, as can be floated on said surface of said molten metal, said floating elements being made of an inorganic refractory material which is insensitive to the molten metal to be covered.

11. The method according to claim 10 wherein said floating elements have a density that falls in the range from 0.7 to 1.4 g/cm$^3$.

12. The method according to claim 10 wherein said floating elements are substantially spherical with a diameter that falls in the range from 10 to 100 millimeters.

13. The method according to claim 10 wherein said floating elements are substantially spherical in shape with a diameter that falls in the range from 10 to 100 millimeters.

14. The method according to claim 10 wherein the molten metal to be covered is aluminum.

* * * * *